US006046702A

United States Patent [19]

Curtis et al.

[11] Patent Number: 6,046,702

[45] Date of Patent: Apr. 4, 2000

[54] PROBE COUPLED, MULTI-BAND COMBINER/DIVIDER

[75] Inventors: John A Curtis, South Jordan; Paul J Gartside, Kaysville; Evan M Fisher, Farmington, all of Utah

[73] Assignee: L-3 Communications Corp., New York, N.Y.

[21] Appl. No.: 09/041,804

[22] Filed: Mar. 13, 1998

[51] Int. Cl.[7] ..... H01Q 13/00

[52] U.S. Cl. ..... 343/776; 343/772; 343/786; 333/126; 333/135

[58] Field of Search ..... 343/771, 772, 343/776, 786; 333/126, 135; H01Q 13/00

[56] References Cited

U.S. PATENT DOCUMENTS

| | | | |
|---|---|---|---|
| 4,491,810 | 1/1985 | Saad | 333/126 |
| 4,912,436 | 3/1990 | Alford et al. | 333/135 |
| 5,874,923 | 2/1999 | Nilsson et al. | 343/786 |
| 5,907,309 | 5/1999 | Anderson et al. | 343/786 |
| 5,910,754 | 6/1999 | Simpson et al. | 333/17.3 |

OTHER PUBLICATIONS

"13 Meter C/Ku Dual Frequency Band Earth Station Antenna", Mitsuyoshi Iida NEC Res. & Develop., No. 99, Oct. 1990, pp. 98–112.

"A Network for Combining Radio Systems at 4, 6 and 11 knc", Earl T. Harkless, The Bell System Technical Journal, Sep. 1959, pp. 1253–1267.

*Primary Examiner*—Don Wong
*Assistant Examiner*—Shih-Chao Chen
*Attorney, Agent, or Firm*—Perman & Green, LLP

[57] ABSTRACT

A passive microwave device combines energy from two microwave communication frequency bands into a common waveguide. Reciprocally, the device separates energy from two microwave frequency bands carried in a common waveguide into separate waveguides for each frequency band. The coupling is accomplished by means of probes that pass between the waveguides. The device can be used for the combination/separation of energy in the X-band and the Ku-band, wherein the Ku-band energy is coupled into/out of a square common waveguide by means of symmetrically positioned coaxial RF coupling probes. The coupling probes extend into both the common waveguide and also into rectangular Ku-band only waveguides. The X-band and Ku band are thus combined and/or separated passively for dual or multi-band antenna feeds in a compact, low cost package. The common waveguide is constructed to include a filter that substantially attenuates any Ku-band energy that would otherwise propagate towards the X-band input/output port. The filter is constructed with symmetrically arrayed ridges or posts that extend into the common waveguide. The combiner/divider device provides extremely broad band passive coupling over the commonly used X and Ku satellite communication frequency bands.

27 Claims, 8 Drawing Sheets

PROBE COUPLED, MULTI-BAND COMBINER/DIVIDER

STATEMENT OF GOVERNMENT RIGHTS

This invention was made with government support under contract number F09604-97-C-0011 awarded by the United States Air Force. The government has certain rights in this invention.

FIELD OF THE INVENTION

This invention relates generally to radio frequency (RF) combiners and dividers and, in particular, to multi-band microwave RF combiners and dividers for antenna feed systems.

BACKGROUND OF THE INVENTION

Two commonly used passive microwave devices for combining RF energy from different bands of wavelengths are a waveguide directional coupler and a turnstile combiner.

FIG. 1 shows the waveguide directional coupler, wherein two side-by-side waveguides 1 and 2 are coupled together using apertures 3. RF energy in a first band of wavelengths (f1) enters through Port_1 and RF energy in a second band of wavelengths (f2) enters through Port_2. In this example it is assumed that f2 is higher in frequency than f1 and, as a result, waveguide 2 has smaller dimensions than waveguide 1. The RF energy from the smaller waveguide 2 couples through the apertures 3 into the larger waveguide 1, but not vice versa. The end result is that the RF energy is combined, and both f1 and f2 exit through Port_3, with minimal f2 energy exiting through Port_4. An f1 matching iris (not shown) may be placed at Port_1 to mitigate the effect of apertures 3, which may cause some of the f1 energy to reflect back to Port_1.

FIG. 2 illustrates the conventional turnstile combiner. In this device a centrally placed waveguide 4 which supports energy in the band of wavelengths f1 defines the Port_1 and Port_3, as in FIG. 1. However, Port_2 and Port_4 are implemented as four symmetrically placed waveguides 5A–5D that feed energy in the band of wavelengths f2 into the central waveguide 4. In practice, the waveguides 5A–5D may be folded against the central waveguide 4. The central waveguide 4 may be a square waveguide, as shown, or could be a coaxial waveguide, or a circular waveguide. The RF energy for f2 enters through either the vertical pair of rectangular ports (Port_2) or through the horizontal pair of rectangular ports (Port_4), and exits through Port_3. Each pair of f2 ports can be viewed as a single port since a pair must be excited at a time to create the desired mode. As in the embodiment of FIG. 1, the RF energy for f2 is coupled into the larger waveguide 4 through holes or apertures 6.

General reference in this regard can be had by referring to the following two publications for showing a C/Ku dual band diplexer and a 4, 6 and 11 GHz combiner, respectively: M. Iida et al., "13 Meter C/Ku Dual Frequency Band Earth Station Antenna", NEC Res. & Develop., vol. 99, pp. 98–112, 1990; and E. T. Harkness, "A Network for Combining Radio Systems at 4, 6 and 11 kmc", The Bell System Tech. Journal, September 1959, pp. 1253–1267.

A problem is created when two frequency bands of interest are close to one another, such as when one wishes to use the X-band (7.25 GHz to 8.4 GHz) and the Ku-band (10.95 GHz to 14.5 GHz). The problem in a broadest aspect relates to providing a single passive combiner/divider having the necessary bandwidth to support operation in both bands, without introducing higher order modes that would adversely affect the operation of the upper band. The conventional aperture-coupled combiners that are known to the inventors do not exhibit the necessary bandwidth for this type of dual band operation.

OBJECTS AND ADVANTAGES OF THE INVENTION

It is a first object and advantage of this invention to provide a broad band microwave combiner/divider.

It is another object and advantage of this invention to provide a passive, broad band combiner/divider device that probe couples higher frequency RF energy from waveguides into and out of a common waveguide though which lower frequency RF energy propagates.

It is a further object and advantage of this invention to provide a passive, broad band probe-coupled combiner/divider device that is operable in the X and Ku bands.

Another object and advantage of this invention is to simultaneously support two orthogonal polarizations in both the X and Ku-bands.

SUMMARY OF THE INVENTION

The foregoing and other problems are overcome and the objects and advantages are realized by methods and apparatus in accordance with embodiments of this invention.

A passive microwave device combines energy from two microwave communication frequency bands into a common waveguide. Reciprocally, the device separates energy from two microwave frequency bands carried in a common waveguide into separate waveguides for each frequency band. The coupling is accomplished by means of electrically conductive probes that pass between each of the separate waveguides and the common waveguide, hence the combiner/divider is referred to herein as being "probe coupled". In the presently preferred embodiment of this invention the device is used for the combination/separation of energy in the X-band and the Ku-band, however, the use of the device at other frequencies and/or its extension for the combination/separation of more than two frequency bands should be readily apparent to one skilled in the art.

In the presently preferred embodiment the Ku-band energy is coupled into/out of a square common waveguide by means of symmetrically positioned coaxial RF coupling probes. The coupling probes extend into the common waveguide and also into rectangular Ku-band only waveguides. The X-band and Ku band are thus combined and/or separated passively for dual or multi-band antenna feeds in a compact, low cost package. For example, an embodiment of the invention provides a four port Ku-band feed without the need of an ortho-mode junction or other similar hardware.

The common waveguide is constructed to include a filter that substantially attenuates any Ku-band energy that would otherwise propagate towards the X-band input/output port. The filter is constructed with symmetrically arrayed ridges or posts that extend into the common waveguide.

The device in accordance with this invention provides extremely broad band passive combining/dividing over the commonly used X and Ku satellite communication frequency bands. The device in accordance with this invention further provides simultaneous operation of an antenna at both X-band and Ku-band, or allows the use of the antenna in either band without mechanical switching or hardware changes. The device in accordance with this invention also provides operation in the X and/or Ku-band, with dual orthogonal polarizations in each band. The device in accordance with this invention also provides reliability, performance and convenience advantages over configurations that require mechanical switching and/or physical hardware changes in order to operate in different bands.

The passive nature of the device and the physical design facilitate operation, particularly at X-band, that is free from passive intermodulation products.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Reference is now made to FIGS. 3, 4A, 4B and 4C for showing an embodiment of a passive probe-coupled combiner/divider device 10 in accordance with the teachings of this invention.

It is first noted that the ensuing description of the device 10 is made in the context of a device that combines or divides RF energy in two frequency bands, specifically the X-band (7.25 GHz to 8.4 GHz) and the Ku-band (10.95 GHz to 14.5 GHz). It should be realized however that this embodiment is exemplary of the teachings of this invention, and that the device 10 is not limited for use with only two frequency bands, nor is the device 10 limited for use with only the X and Ku bands. Thus, while the device 10 will be described with reference to various dimensions and the like that are specific to operation in the X and Ku bands, these dimensions and the like are exemplary, and should not be construed as a limitation upon the practice of this invention.

Figure 1:
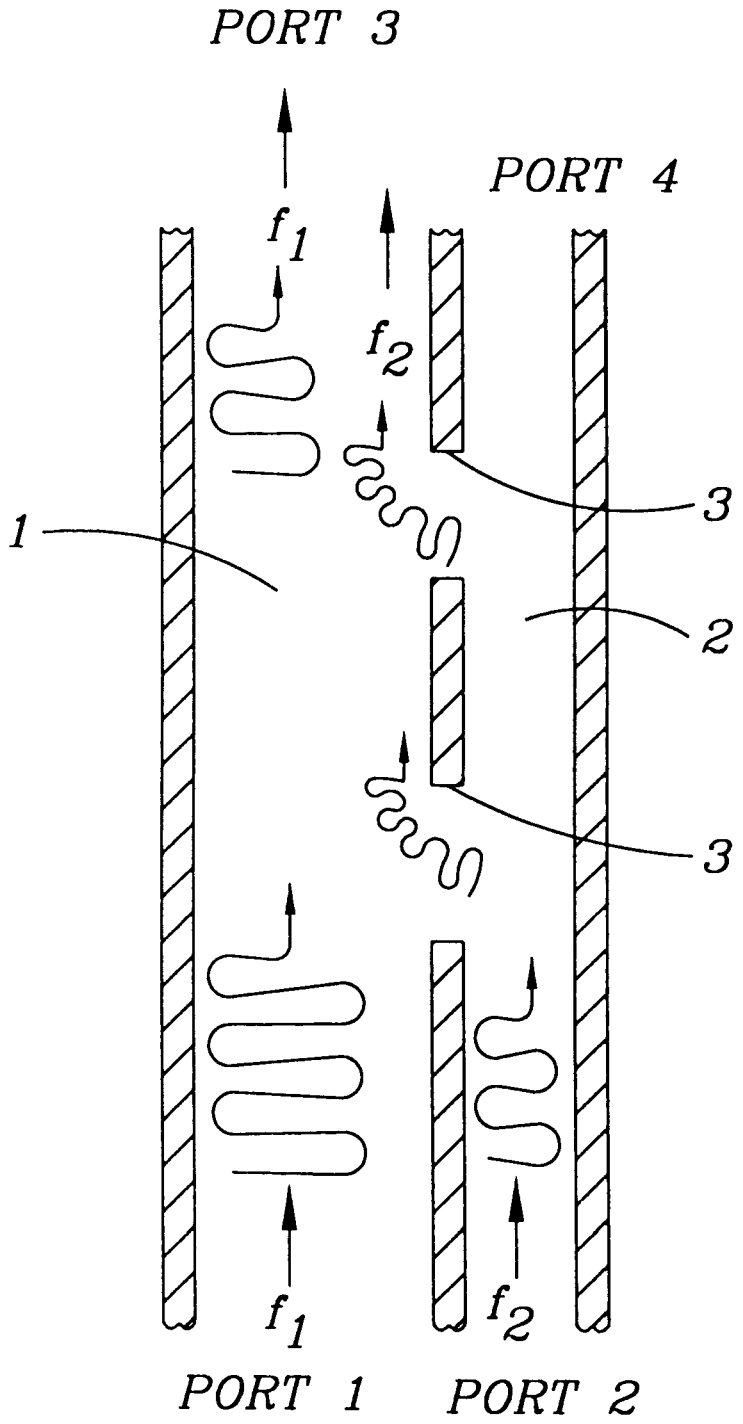
FIG. 1 (PRIOR ART)
FIG. 1 is simplified cross-sectional view of a conventional waveguide directional coupler.
Figure 2:
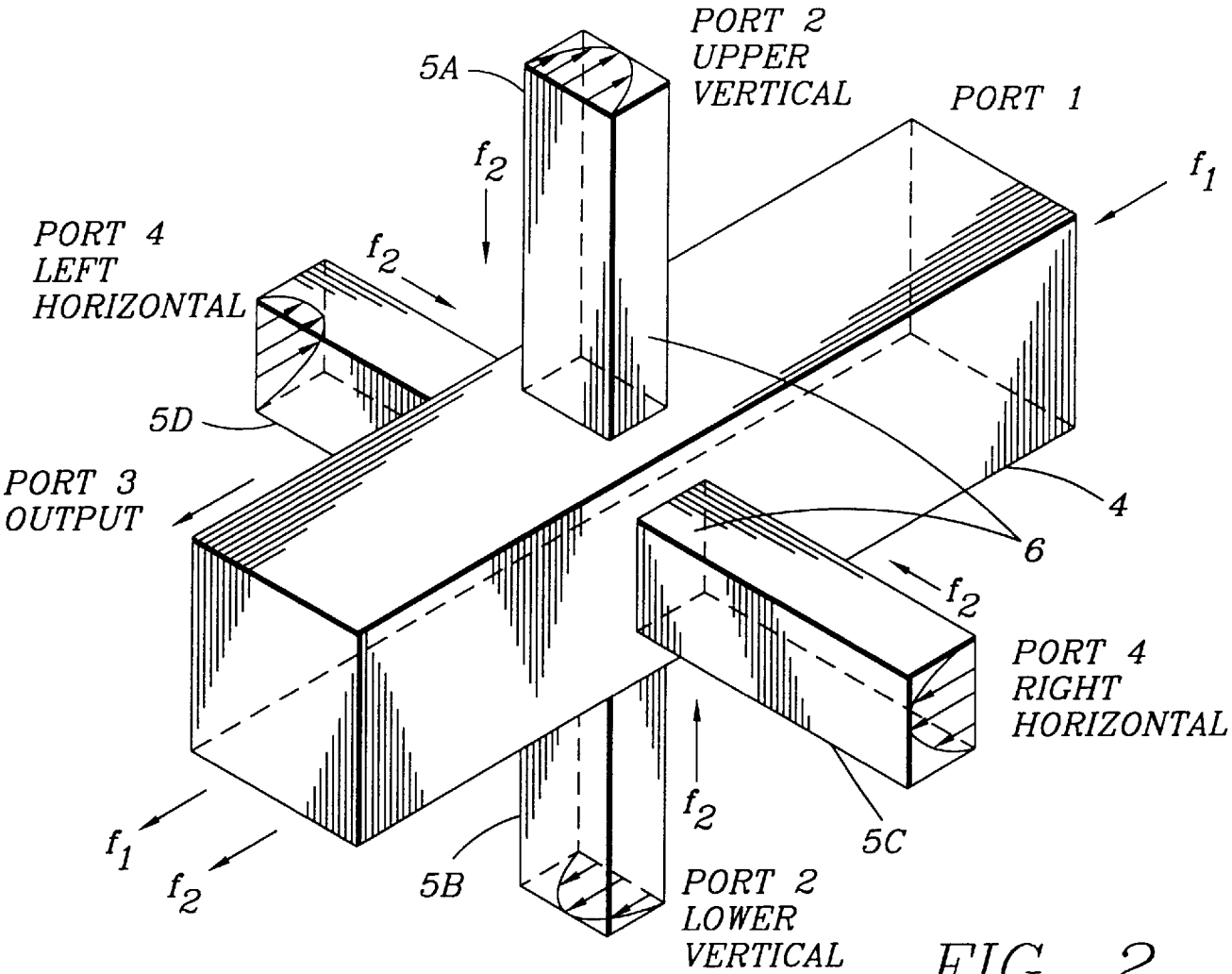
FIG. 2 (PRIOR ART)
FIG. 2 is an elevational view of a conventional turnstile combiner.
Figure 3:
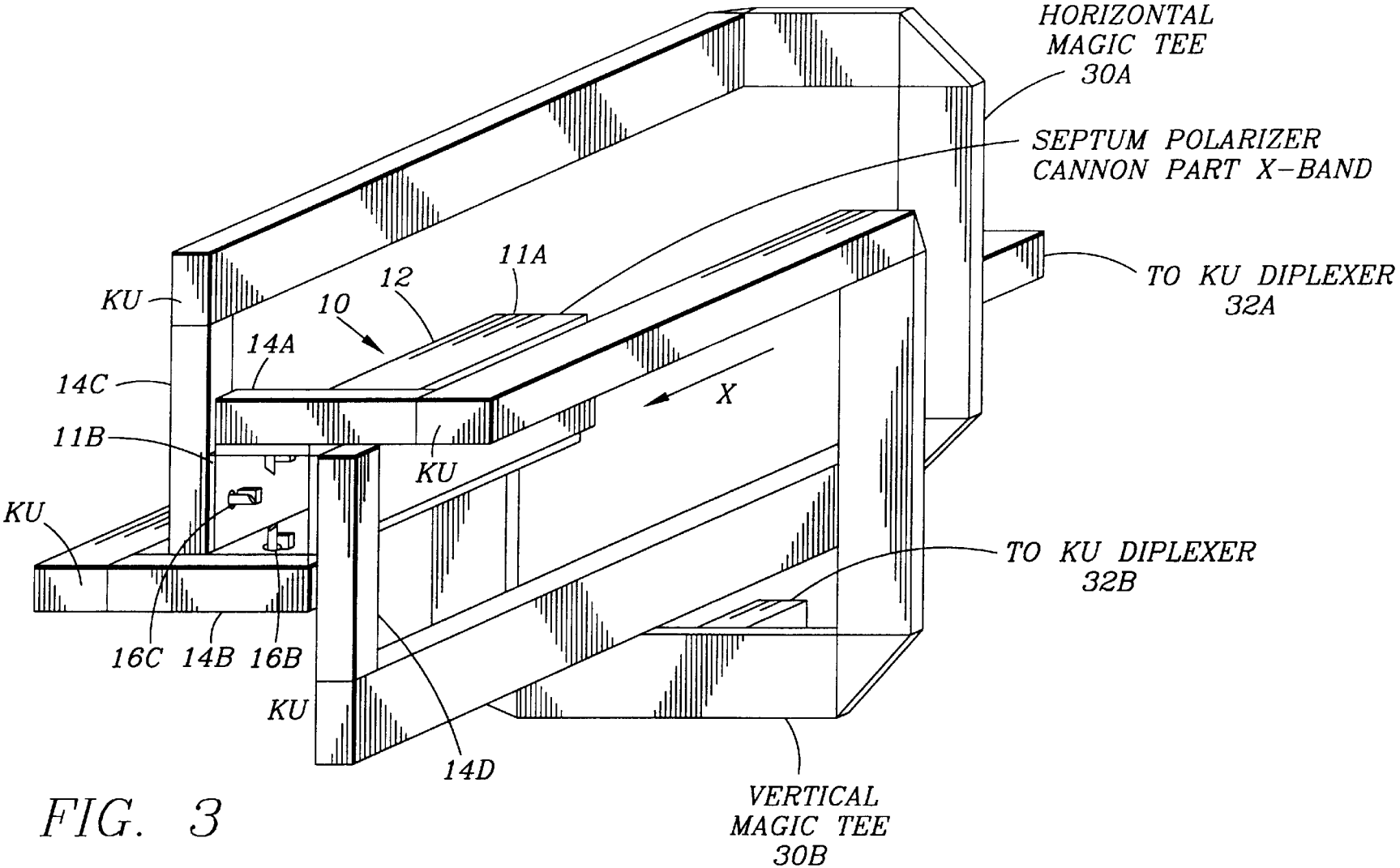
FIG. 3 is an elevational view of the passive probe-coupled combiner/divider in accordance with this invention.

A central waveguide 12 has a first input/output port 11A, also referred to as a septum polarizer common port, and a second input/output port 11B for coupling to an antenna element, such as a transmitter/receiver feed horn (not shown). The septum polarizer (not shown) provides right hand circular X-band polarization for transmit and left hand circular X-band polarization for receive, or vice versa. For convenience, the remaining description will be made primarily in the context of the transmission of RF energy, and the arrows showing the direction of X-band and Ku-band RF energy are thus referenced to the combiner function in the transmit mode. However, it should be kept in mind that the device 10 is also adapted for receiving RF energy, and in this case these arrows would be reversed for showing the RF energy divider function in the receive direction. In FIG. 3 it is assumed that circularly or linearly polarized X-band RF energy is launched into the waveguide 12 in the direction indicated by the arrow designated X.

Arrayed about the central waveguide 12 are a plurality of Ku-band waveguides 14A, 14B, 14C and 14D. The Ku-band waveguides are operated in pairs for launching vertically polarized Ku-band RF energy (waveguides 14A and 14B) and horizontally polarized Ku-band RF energy (waveguides 14C and 14D) into the waveguide 12.

Figures 4A, 4B, 4C:
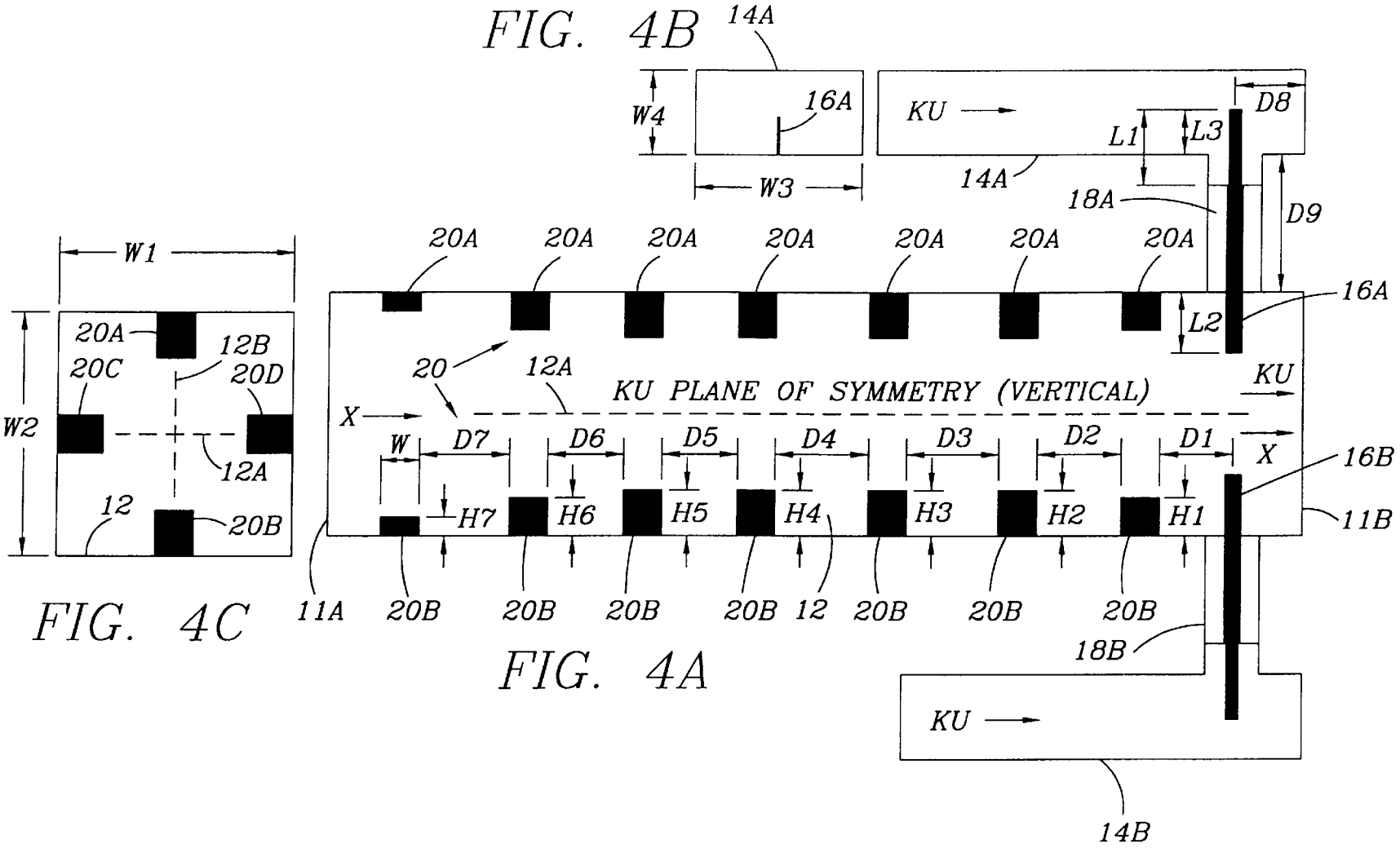
FIG. 4A is a cross-sectional side view of the passive probe-coupled combiner/divider showing a portion of the central waveguide and top and bottom Ku band waveguides.
FIG. 4B is an end view looking into the top Ku band waveguide.
FIG. 4C is an end view looking into the central waveguide.

In accordance with an aspect of this invention the Ku-band RF energy from waveguides 14A–14D is coupled into the waveguide 12 through probes 16A–16D. Each probe 16 extends partially into the associated Ku-band waveguide 14 and partially into the waveguide 12 (as best seen in FIG. 4A), and is partially surrounded by a dielectric material 18 such as Teflon™. The probes 16A–16D may thus be considered as coaxial probes for coupling Ku-band RF energy from the waveguides 14 into the central waveguide 12, thereby combining the Ku-band and the X-band RF energy. In a corresponding fashion, the probes 16A–16D may also be considered as coaxial probes for coupling Ku-band RF energy out of the central waveguide 12, thereby dividing the Ku-band energy from the X-band energy. The end of the coupling probe 16 that is located in the Ku-band waveguide 14 may be of a smaller diameter than the end located in the central waveguide 12 (e.g., 0.04 inch versus 0.06 inch for the illustrated embodiment.)

Figure 5B:
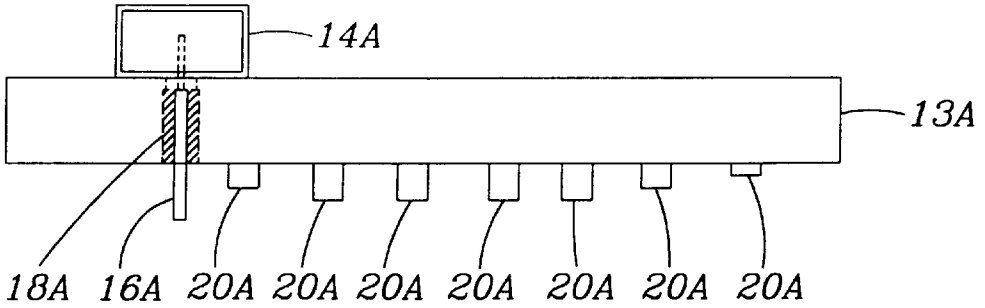
FIGS. 5A, 5B, 5C are plan, side and end views, respectively, of the top side structure of the central waveguide and the Ku band waveguide.
Figure 5A:
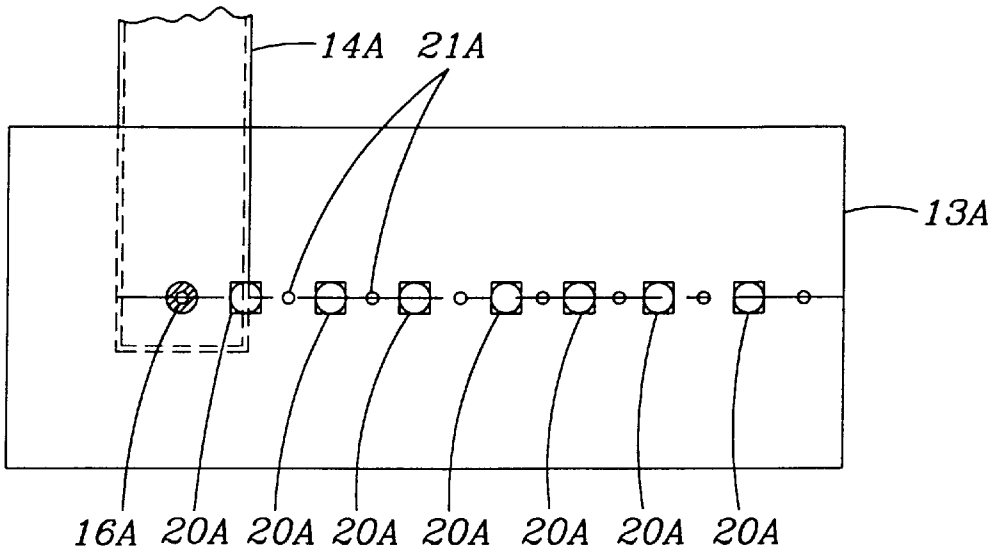
Figure 5C:
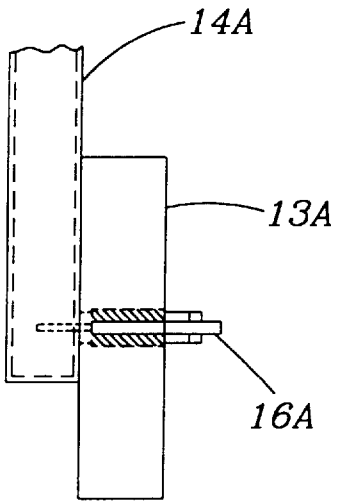
Figure 6C:
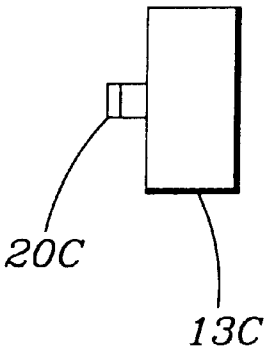
FIGS. 6A, 6B, 6C are plan, side and end views, respectively, of one side structure of the filter in the central waveguide.
Figure 6A:
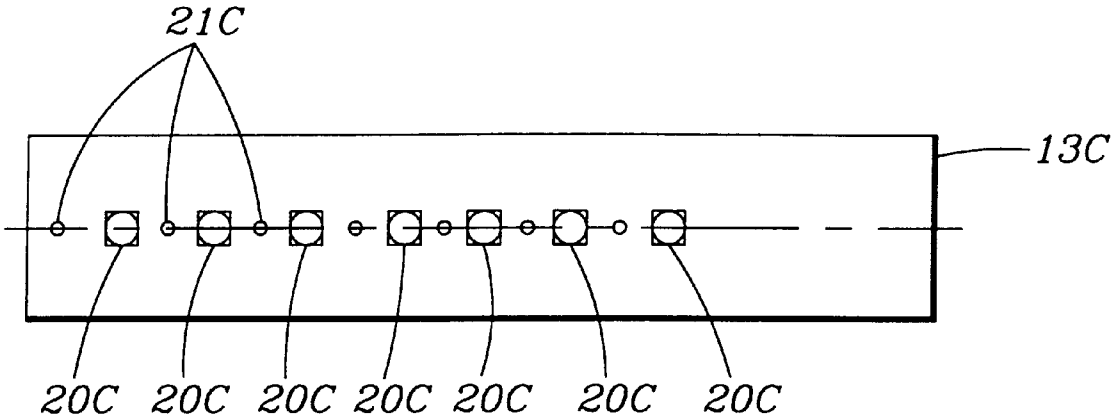
Figure 6B:
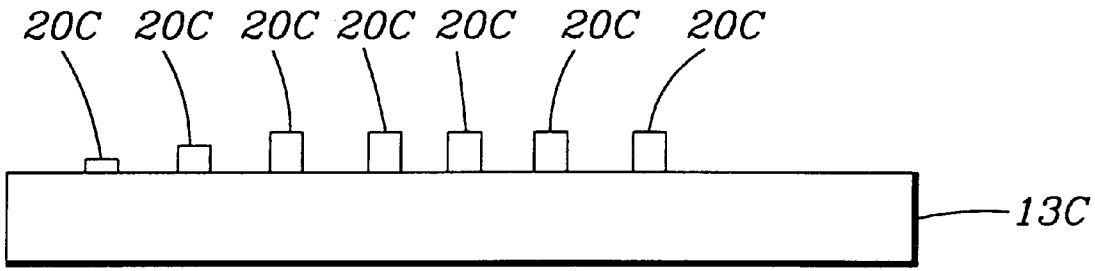

FIGS. 5A, 5B, 5C are plan, side and end views, respectively, that show in greater detail the top side structure of the central waveguide 12 and the Ku band waveguide 14A, while FIGS. 6A, 6B, 6C are plan, side and end views, respectively, of one side structure of the central waveguide 12. When viewed in conjunction with FIG. 4A the location and construction of a filter 20 is also made apparent. The filter 20 is comprised of a plurality of ridges or posts 20A, 20B, 20C, 20D that are arrayed symmetrically about a portion of the length of the waveguide 12, and that extend partially into the waveguide 12. The filter 20 rejects the Ku-band RF energy that is launched by the coupling probes 16A–16D while passing the X-band energy. In a preferred embodiment the filter 20 attenuates the Ku-band energy travelling towards the input/output port 11A by at least 30 dB (see FIG. 8).

In the embodiment shown best in FIGS. 5A and 6A the filter posts 20 are threaded for receiving tuning screws (not shown) that can be inserted from outside the waveguide 12 so as to extend above the top of the posts 20 and into the waveguide 12. Also shown are threaded holes 21 made through plates 13A and 13C, between the posts 20, through which tuning screws may also be inserted into the central waveguide 12. It should be appreciated that the use of such tuning screws is optional, and in some embodiments may be eliminated in whole or in part. The plates 13 and posts 20 may be comprised of any suitable electrically conductive material that is typically used for constructing microwave waveguides and related components. The coupling probes 16 may be comprised of a beryllium/copper alloy, or any suitable electrically conductive material.

FIG. 4C shows that central waveguide input/output ports 11A and 11B preferably have a square cross-section, a shape that provides the waveguide 12 with a bandwidth for supporting the circularly polarized X-band RF energy, whereas the upper and lower Ku-band waveguides 14A and 14B can be seen in FIG. 4B to have a rectangular shape that provides the waveguides 14A and 14B (as well as 14C and 14D) with a bandwidth for supporting the linearly polarized Ku-band RF energy. The X-band energy is cutoff by the rectangular Ku-band waveguides and does not propagate in them.

It is important to note that the center waveguide 12, having a square cross section, will simultaneously support two orthogonal polarizations at both X-band and Ku-band.

Figure 7:
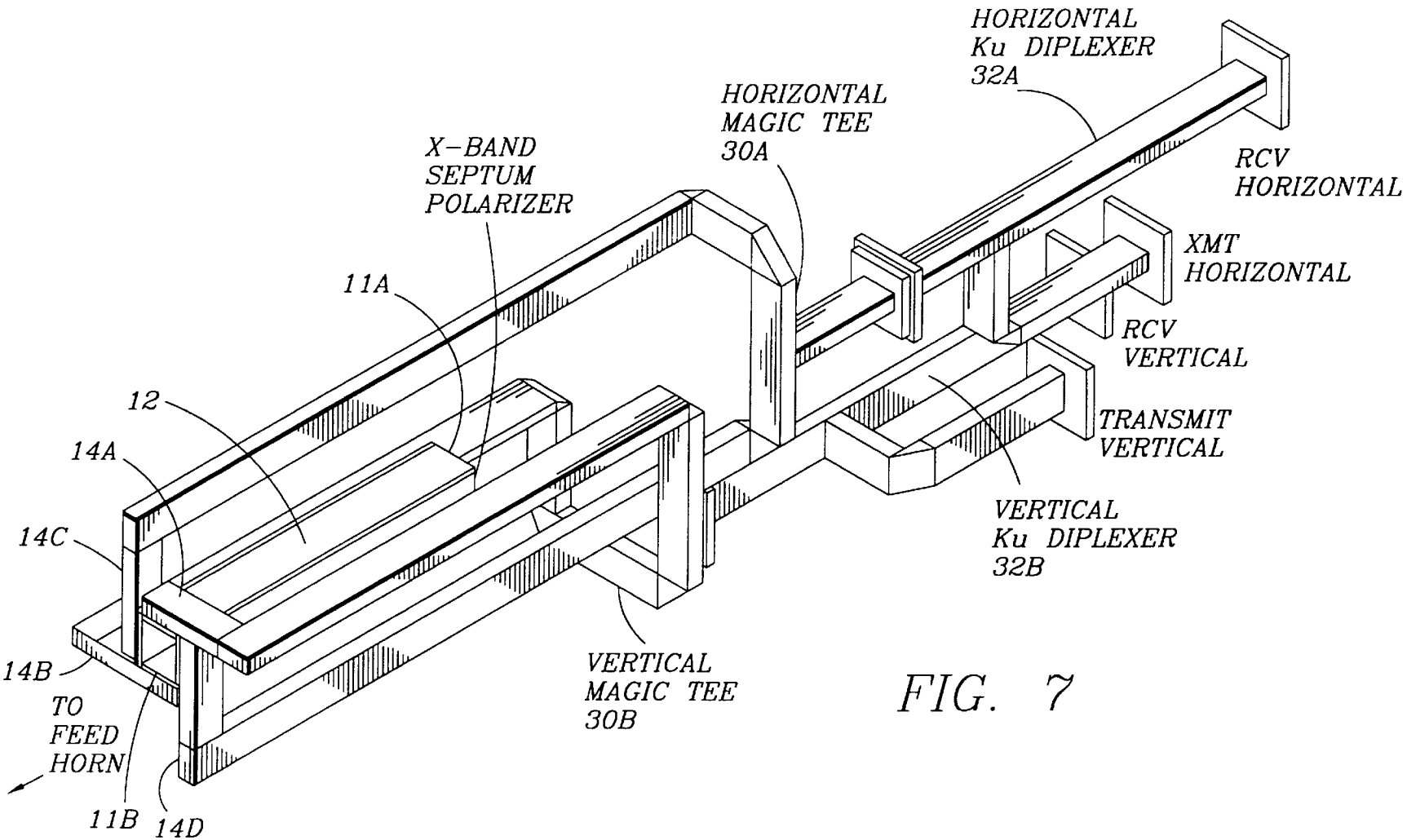
FIG. 7 is an elevational view of the probe-coupled combiner/divider coupled with hybrid tees for feeding the Ku-band ports, and shows the role of the combiner/divider device in an exemplary antenna feed system.

In a presently preferred embodiment of this invention the square waveguide 12 has dimensions of 0.88 inch by 0.88 inch. As such, in the square waveguide 12 the cutoff frequency of the fundamental mode, the TE10 mode, is 6.71 GHz. The TE01 mode, which is simply the TE10 mode rotated 90 degrees (orthogonal mode), also has a cutoff frequency of 6.71 GHz. Since the next higher order mode is the TE11, which has a cutoff frequency of 9.48 GHz, the square waveguide 12 has the single mode bandwidth to support both senses of the circularly polarized X-band energy from 6.71 to 9.48 GHz. In the Ku-band, however, the square waveguide 12 supports more than one mode. The TE11 and TM11 modes both have a cutoff frequency of 9.48 GHz and the TE20 and TE02 modes both have a cutoff frequency of 13.41 GHz. However, since the square waveguide 12 is fed by symmetrical pairs of Ku-band rectangular waveguides, either left and right horizontal waveguides 14C and 14D, or upper and lower vertical waveguides 14A and 14B, carrying equal amplitude TE10 modes 180 degrees out of phase, the unwanted modes are not excited. Only the TE10 mode will be created in the square waveguide. The Ku-band signal can be equally split into two paths by a Magic Tee (30A horizontal and 30B vertical) and fed into the square waveguide 12 as shown in FIG. 7. Within the waveguide 12 the Ku-band energy from a pair of waveguides 14A,B/14C,D adds constructively to form one signal. FIG. 7 also shows the Magic Tees 30A and 30B connected to Ku diplexers 32A and 32B, respectively.

It can be noted in FIGS. 4A and 4C that the Ku-band energy that is probe-coupled from the upper and lower vertical waveguides 14A and 14B, or from left and right horizontal waveguides 14C and 14D, experiences an effective perfect conductive plane 12A or 12B, respectively, located at the center of the symmetrical square waveguide 12. The effect is that each Ku-band probe 16 "sees" an effective 0.88 inch by 0.44 inch rectangular waveguide through which the linearly polarized Ku-band energy can propagate. A 0.88 inch by 0.44 inch waveguide will propagate single mode energy from 6.71 GHz to 15.0 GHz, provided proper symmetry is maintained.

In the preferred embodiment of this invention the location of the first filter post 20, i.e., the one nearest the probe 16, is approximately ¼λ of the higher frequency RF energy, the Ku-band in this case. This distance is designated as D1 in FIG. 4A. It can further be seen that each Ku-band waveguide 14 extends past the probe 16 by a distance D8. This distance is also approximately ¼λ of the higher frequency RF energy. The following Table specifies a number of various dimensions, in inches, for the illustrated X-band/Ku-band device 10, it being remembered that these dimensions are exemplary of but one embodiment, and are not intended to be read in a sense that would limit the practice or teaching of this invention.

TABLE

| | |
|---|---|
| W | 0.16 |
| W1 | 0.88 |
| W2 | 0.88 |
| W3 | 0.62 |
| W4 | 0.31 |
| D1 | 0.27 |
| D2 | 0.28 |
| D3 | 0.32 |
| D4 | 0.34 |
| D5 | 0.24 |
| D6 | 0.26 |
| D7 | 0.32 |
| D8 | 0.25 |
| D9 | 0.51 |
| L1 | 0.27 |
| L2 | 0.22 |
| L3 | 0.16 |
| H1 | 0.14 |
| H2 | 0.18 |
| H3 | 0.18 |
| H4 | 0.18 |
| H5 | 0.14 |
| H6 | 0.08 |

These various dimensions can be modified as required. For example, the dimensions related to the filter 20 can be modified so as to favor or weight the performance towards, by example, the Ku receive band, the Ku transmit band, or towards the X-band. Those skilled in the art, when guided by the teachings of this invention, should be capable of varying the disclosed dimensions in order to obtain a desired effect.

Figure 8:
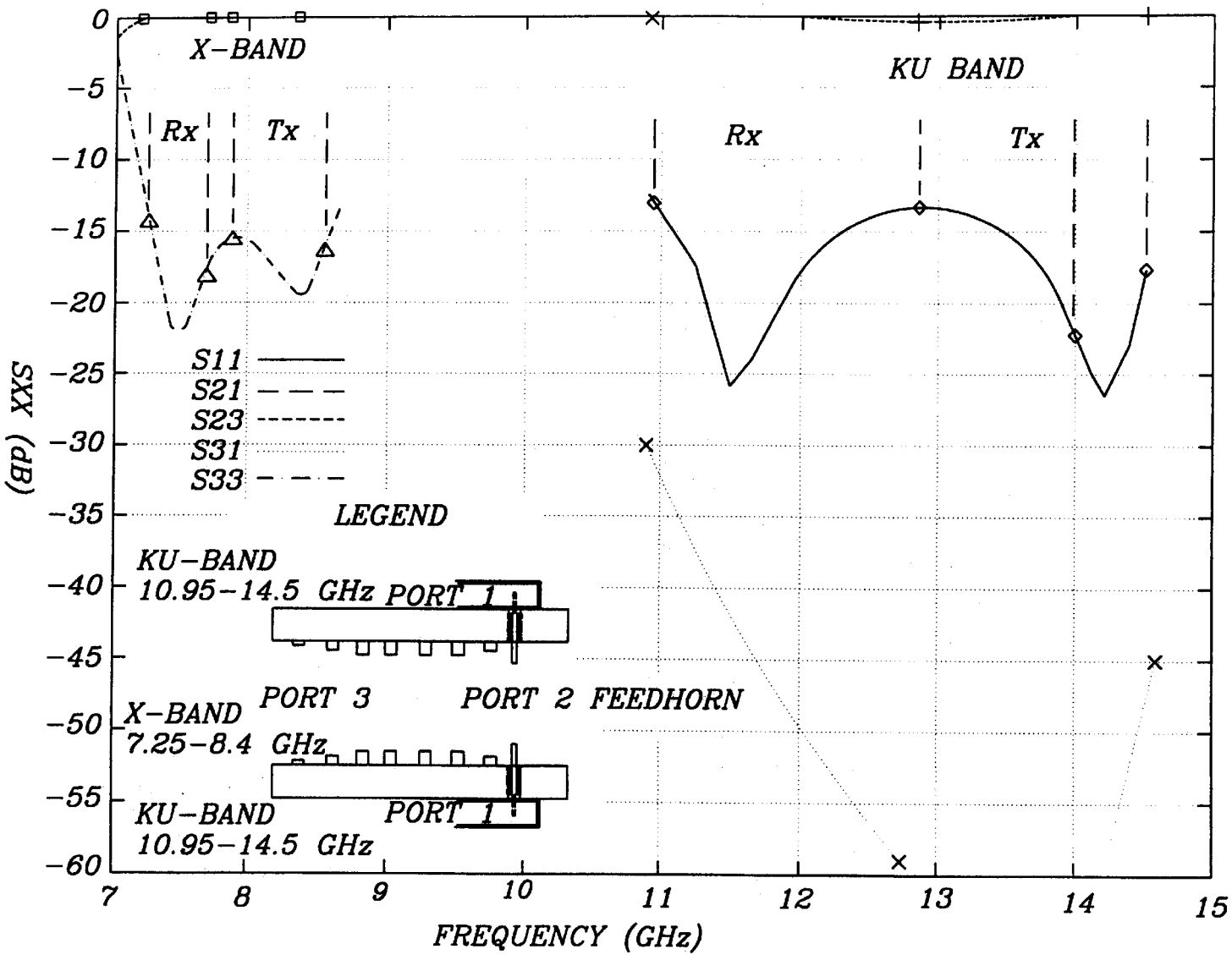
FIG. 8 is graph that depicts the operation of an intercommon waveguide filter for rejecting Ku-band energy from the X-band path, FIG. 8 also depicting the insertion loss performance of the combiner for X and Ku-band energy through their respective paths.

FIG. 8 graphically depicts the effect of the filter 20, having the filter dimensions as shown above, in rejecting the Ku-band energy. Note that at the upper edge of the Ku receive (Rx) band that the energy is attenuated by approximately 60 dB.

As FIG. 8 clearly shows, the device 10 in accordance with this invention provides extremely broad band passive coupling over the commonly used X and Ku satellite communication frequency bands. The device 10 in accordance with this invention further provides simultaneous operation of an antenna at both X-band and Ku-band, or allows the use of the antenna in either band in a passive manner without requiring switching or hardware changes. The device 10 in accordance with this invention further supports two orthogonal polarizations at X-band and at Ku-band. The device 10 in accordance with this invention also provides reliability, performance and convenience advantages over configurations that require mechanical switching and/or physical hardware changes in order to operate in different bands. The passive nature of the device also makes practical a performance that is free of passive intermodulation products.

It should be noted that while the invention has been described in the context of square and rectangular waveguides, the teaching of the invention can be realized using circular waveguides.

It should be further noted that the construction of the filter 20 can be implemented with other filter elements, and is not required to use the ridges or posts.

Thus, while the invention has been particularly shown and described with respect to preferred embodiments thereof, it will be understood by those skilled in the art that changes in form and details may be made therein without departing from the scope and spirit of the invention.

What is claimed is:

1. A combiner/divider device for RF energy, comprising:

a first waveguide through which first RF energy propagates, the first RF energy being in a first frequency band;

a plurality of second waveguides through which second RF energy propagates, the second RF energy being in a second frequency band that is higher in frequency than the first frequency band; and a plurality of electrically conductive probes individual ones of which couple the second RF energy between one of said second waveguides and said first waveguide.

2. The combiner/divider device as in claim 1, wherein the first frequency band is comprised of the X-band, and wherein the second frequency band is comprised of the Ku-band.

3. The combiner/divider device as in claim 1, wherein the first RF energy propagates bidirectionally through said first waveguide, and further comprising a filter disposed within said first waveguide for inhibiting said second RF energy from propagating through a portion of said first waveguide.

4. The combiner/divider device as in claim 3, wherein said filter is comprised of a plurality of electrically conductive posts that extend from sidewalls of said first waveguide into said first waveguide.

5. The combiner/divider device as in claim 1, wherein said first waveguide has a substantially square cross-section, and wherein each of said second waveguides has a substantially rectangular cross-section.

6. The combiner/divider device as in claim 2, wherein said first waveguide has a substantially square cross-section that is about 0.88 inch by about 0.88 inch, and wherein each of said second waveguides has a substantially rectangular cross-section that is about 0.62 inch by 0.31 inch.

7. The combiner/divider device as in claim 1, wherein each of said electrically conductive probes is surrounded along a portion of its length by a dielectric material.

8. The combiner/divider device as in claim 1, wherein said plurality of second waveguides are comprised of:

a first pair of second waveguides coupled to said first waveguide through first and second probes, respectively, that are disposed on first and second sides of said first waveguide, said first and second sides being disposed opposite from one another; and a second pair of second waveguides coupled to said first waveguide through third and fourth probes, respectively, that are disposed on third and fourth sides of said first waveguide, said third and fourth sides being disposed opposite from one another and perpendicularly to said first and second sides;

wherein the second RF energy coupled through said first and second probes is vertically polarized and is phased such that it is additively combined in the first waveguide; and wherein the second RF energy coupled through said third and fourth probes is horizontally polarized and is phased such that it is additively combined in the first waveguide.

9. The combiner/divider device as in claim 8, wherein said first RF energy is circularly polarized or linearly polarized.

10. A method for combining/dividing RF energy, comprising steps of:

propagating first RF energy through a first waveguide, the first RF energy being in a first frequency band;

propagating second RF energy though a plurality of second waveguides, the second RF energy being in a second frequency band that is higher in frequency than the first frequency band; and coupling the second RF energy between the second waveguides and the first waveguide through a plurality of electrically conductive probes individual ones of which couple one of the second waveguides to the first waveguide.

11. The method as in claim 10, wherein the first frequency band is comprised of the X-band, and wherein the second frequency band is comprised of the Ku-band.

12. The method as in claim 10, wherein the first RF energy propagates bidirectionally through the first waveguide, and further comprising a step of providing a filter within the first waveguide for inhibiting the second RF energy from propagating through a portion of the first waveguide.

13. A combiner/divider device for use with X-band and Ku-band RF energy, comprising:

a common waveguide having a first port and a second port, the first port being coupled to an antenna and the second port being coupled to a circular polarizer for X-band RF energy, the X-band RF energy being capable of propagating bidirectionally through said common waveguide;

a plurality of waveguides through which Ku-band RF energy is capable of being bidirectionally directed to and from the common waveguide, said plurality of waveguides being comprised of a first pair of waveguides that are RF coupled to said common waveguide through first and second electrically conductive probes, respectively, that are disposed on first and second sides of said common waveguide, said first and second sides being disposed opposite from one another, said plurality of waveguides further comprising a second pair of waveguides that are RF coupled to said common waveguide through third and fourth electrically conductive probes, respectively, that are disposed on third and fourth sides of said common waveguide, said third and fourth sides being disposed opposite from one another and perpendicularly to said first and second sides, wherein the Ku-band RF energy that is coupled through said first and second probes is vertically polarized and is 180 degrees out of phase such that it combines additively in the center waveguide, and wherein the Ku-band RF energy that is coupled through said third and fourth probes is horizontally polarized and is 180 degrees out of phase such that it combines additively in the center waveguide; and a filter disposed within said common waveguide for causing said Ku-band RF energy to not propagate through said first waveguide between said probes and said second port.

14. The combiner/divider device as in claim 13, wherein said filter is comprised of a plurality of electrically conductive posts that extend from sidewalls of said common waveguide into said common waveguide.

15. The combiner/divider device as in claim 13, wherein said common waveguide has a substantially square cross-section, and wherein each of said plurality of waveguides has a substantially rectangular cross-section.

16. The combiner/divider device as in claim 13, wherein said common waveguide as a substantially square cross-section that is about 0.88 inch by about 0.88 inch, and wherein each of said plurality of waveguides has a substantially rectangular cross-section that is about 0.62 inch by 0.31 inch.

17. The combiner/divider device as in claim 13, wherein each of said electrically conductive probes is surrounded along a portion of its length by a dielectric material.

18. A combiner/divider device for RF energy, comprising:

a first waveguide through which first RF energy propagates, the first RF energy being in a first frequency band;

a plurality of second waveguides through which second RF energy propagates, the second RF energy being in a second frequency band that is higher in frequency than the first frequency band; and a plurality of electrically conductive probes individual ones of which couple the second RF energy between one of said second waveguides and said first waveguide, wherein said first waveguide is constructed so as to simultaneously support two orthogonal polarizations for both the first RF energy and the second RF energy.

19. The combiner/divider device as in claim 18, wherein the first frequency band is comprised of the X-band and the second frequency band is comprised of the Ku-band, wherein the X-band RF energy has one of right hand circular polarization or left hand circular polarization, and wherein the Ku-band RF energy has vertical and horizontal polarizations.

20. A combiner/divider device for RF energy, comprising:

a first waveguide through which first RF energy propagates, the first RF energy being in a first frequency band;

a plurality of second waveguides through which second RF energy propagates, the second RF energy being in a second frequency band that is higher in frequency than the first frequency band; and a plurality of electrically conductive probes individual ones of which couple the second RF energy between one of said second waveguides and said first waveguide, wherein said first waveguide is constructed so as to provide operation that is substantially free of passive intermodulation products.

21. The combiner/divider device as in claim 20, wherein the first frequency band is comprised of the X-band and the second frequency band is comprised of the Ku-band, wherein the X-band RF energy has one of right hand circular polarization or left hand circular polarization, and wherein the Ku-band RF energy has vertical and horizontal polarizations.

22. An antenna system, comprising:

an antenna element;

a combiner/divider device comprising a common waveguide having one end coupled to said antenna element and a second end coupled to an X-band port, a plurality of Ku-band waveguides, and a plurality of electrically conductive probes individual ones of which couple Ku-band energy between one of said Ku-band waveguides and said common waveguide;

a first splitter/combiner coupling a pair of said Ku-band waveguides to a transmit/receive horizontal polarization diplexer; and a second splitter/combiner coupling another pair of said Ku-band waveguides to a transmit/receive vertical polarization diplexer.

23. The antenna system as in claim 22, and further comprising an X-band septum polarizer coupled to said second end of said common waveguide.

24. The antenna system as in claim 22, wherein said first and second splitter/combiners are each comprised of a hybrid tee.

25. The antenna system as in claim 22, wherein said common waveguide is constructed so as to simultaneously support two orthogonal polarizations in both the X-band and the Ku-band.

26. The antenna system as in claim 25, wherein X-band RF energy has one of right hand circular polarization or left hand circular polarization, and wherein the Ku-band energy has vertical and horizontal polarizations.

27. The antenna system as in claim 22, wherein said antenna system operates at X-band only, at Ku-band only, or simultaneously at X-band and at Ku-band.

* * * * *